US009997101B2

(12) United States Patent
Sun et al.

(10) Patent No.: US 9,997,101 B2
(45) Date of Patent: Jun. 12, 2018

(54) GATE SCAN CIRCUIT, DRIVING METHOD THEREOF AND GATE SCAN CASCADE CIRCUIT

(71) Applicants: Shanghai Tianma AM-OLED Co., Ltd., Shanghai (CN); Tianma Micro-Electronics Co., Ltd., Shenzhen (CN)

(72) Inventors: Kuo Sun, Shanghai (CN); Wenhui Zou, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 170 days.

(21) Appl. No.: 15/139,334

(22) Filed: Apr. 27, 2016

(65) Prior Publication Data

US 2017/0084222 A1 Mar. 23, 2017

(30) Foreign Application Priority Data

Sep. 22, 2015 (CN) ..... 2015 1 0608268

(51) Int. Cl.
*G09G 3/32* (2016.01)
*G09G 3/3266* (2016.01)

(52) U.S. Cl.
CPC ..... *G09G 3/32* (2013.01); *G09G 3/3266* (2013.01); *G09G 2300/0842* (2013.01); *G09G 2310/0262* (2013.01); *G09G 2310/0267* (2013.01); *G09G 2310/0286* (2013.01); *G09G 2310/08* (2013.01)

(58) Field of Classification Search
None
See application file for complete search history.

(56) References Cited

U.S. PATENT DOCUMENTS

2006/0038500 A1* 2/2006 Lee ..... H01L 27/1214 315/169.1
2010/0039423 A1* 2/2010 Jeong ..... G09G 3/3266 345/213
2012/0176417 A1* 7/2012 Jang ..... G09G 3/3266 345/690
2013/0033468 A1* 2/2013 Takahashi ..... G09G 3/20 345/204
2013/0241431 A1* 9/2013 Toyotaka ..... H05B 37/02 315/224

(Continued)

*Primary Examiner* — Claire X Pappas
*Assistant Examiner* — Benjamin Casarez
(74) *Attorney, Agent, or Firm* — Kilpatrick Townsend & Stockton LLP

(57) ABSTRACT

A gate scan circuit is provided, which can include a first and a second control units, a first and second output units, and a first capacitor. The first control unit can control a voltage at a first node based on clock signals and an input signal. The second control unit can control a voltage at a second node based on a clock signal and a power source signal. The first and second output units can output a clock signals or power source signals based on the voltage at the first or second node. The first capacitor can include a first terminal receiving the second power source signal and a second terminal connected to the second node. The gate scan circuit may output two scan signals within one circuit, thereby narrowing the frame.

4 Claims, 8 Drawing Sheets

(56) References Cited

U.S. PATENT DOCUMENTS

| | | | | |
|---|---|---|---|---|
| 2013/0285888 | A1* | 10/2013 | Chung | G11C 19/28 345/55 |
| 2014/0111092 | A1* | 4/2014 | Kim | H05B 37/02 315/127 |
| 2014/0375616 | A1 | 12/2014 | Kim et al. | |
| 2015/0035733 | A1* | 2/2015 | Woo | G09G 3/3266 345/76 |
| 2015/0061982 | A1* | 3/2015 | Woo | G09G 3/3266 345/82 |
| 2015/0235584 | A1* | 8/2015 | Eom | G09G 3/3233 345/213 |
| 2016/0049116 | A1* | 2/2016 | Cao | G09G 3/3258 345/213 |
| 2016/0180800 | A1* | 6/2016 | Zheng | G09G 5/003 345/213 |

* cited by examiner

GATE SCAN CIRCUIT, DRIVING METHOD THEREOF AND GATE SCAN CASCADE CIRCUIT

CROSS-REFERENCE TO RELATED APPLICATIONS

This application is based upon and claims priority to Chinese Patent Application 201510608268.8, filed on Sep. 22, 2015, the entire contents of which are incorporated herein by reference.

TECHNICAL FIELD

The present disclosure relates to the field of display, and more particularly, to a gate scan circuit, a driving method thereof and a gate scan cascade circuit including the gate scan circuit.

BACKGROUND

In the prior art, a gate scan circuit is generally composed of a plurality of transistors and at least one capacitor, and outputs a scan signal by receiving various input signals. With respect to a known light emitting circuit, generally at least two scan signals are required to emit light, and thus at least two gate scan circuits are required to provide the scan signals to the light emitting circuit. As well known, currently, display devices with narrower frame and lower manufacturing cost are commercially required. Accordingly, it is desired to develop a gate scan circuit that outputs more scan signals while narrowing the frame.

SUMMARY

With respect to the problems in the prior art, the present disclosure provides a technical solution as follow, including:

providing a gate scan circuit including:

a first control unit configured to control a voltage at a first node based on a first clock signal, a second clock signal, a third clock signal and a first input signal;

a second control unit configured to control a voltage at a second node based on the third clock signal and a first power source signal;

a first output unit configured to output the first clock signal or a second power source signal based on the voltage provided to the first node or the second node;

a second output unit configured to output the second clock signal or the second power source signal based on the voltage provided to the first node or the second node; and a first capacitor comprising a first terminal configured to receive the second power source signal and a second terminal connected to the second node.

With the gate scan circuit provided by the present disclosure, the entire circuit structure is constituted using a single type of transistor, and two scan signals may be outputted form one circuit with relative less number of transistors, thereby narrowing the frame.

BRIEF DESCRIPTION OF THE DRAWINGS

In order to describe the technical solutions in the present disclosure in further detail, drawings that are referred to in the description of the embodiments are briefly introduced. Obviously, drawings in the following description are only some embodiments of the present disclosure, other drawings may be obtained based on these drawings by those ordinary skilled in the art without creative labors.

DETAILED DESCRIPTION

Hereinafter, technical solutions in the embodiments are described clearly and completely with reference to the drawings in the embodiments of the present disclosure. Obviously, the described embodiments are only a part of the embodiments of the present disclosure, instead of being all embodiments of the present disclosure. Based on the embodiments in the present disclosure, all the other embodiments obtained by those ordinary skilled in the art without creative labors are involved in the protection scope of the present disclosure.

Figure 1:
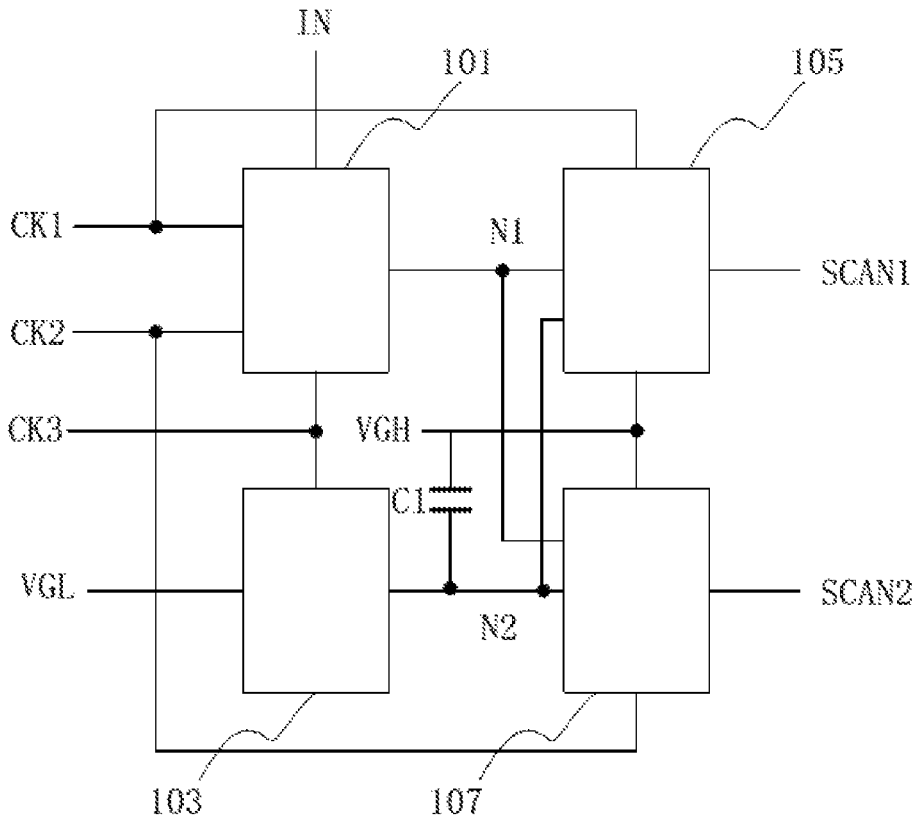
FIG. 1 is a gate scan circuit provided by embodiments of the present disclosure.

As illustrated in FIG. 1, a gate scan circuit provided by the embodiments of the present disclosure is shown. The gate scan circuit includes: a first control unit 101 for controlling a voltage at a first node N1 based on a first clock signal CK1, a second clock signal CK2, a third clock signal CK3 and a first input signal IN. The gate scan circuit includes a second control unit 103 for controlling a voltage at a second node N2 based on the third clock signal CK3 and a first power source signal VGL. The gate scan circuit includes a first output unit 105 for outputting the first clock signal CK1 as a first scan signal SCAN1 or a second power source signal VGH as the first scan signal SCAN1 based on the voltage provided to the first node N1 or the second node N2. The gate scan circuit includes a second output unit 107 for outputting the second clock signal CK2 as a second scan signal SCAN2 or the second power source signal VGH as the second scan signal SCAN2 based on the voltage provided to the first node N1 or the second node N2. The gate scan circuit includes a first capacitor C1 having a first terminal receiving the second power source signal VGH and a second terminal connected to the second node N2.

It should be noted that with respect to the gate scan circuit provided in FIG. 1, each of the first control unit 101, the second control unit 103, the first output unit 105 and the second output unit 107 includes a plurality of transistors. In order for control unit 103 showing in FIG. 1 to receive the first power source signal VGL and for the first output unit 105 and the second output unit 107 shown in FIG. 1 to receive the second power source signal VGH, all of the transistors included in the first control unit 101, the second control unit 103, the first output unit 105 and the second output unit 107 are P-type transistors. However, this is not intended to be limiting. That is, when all the transistors included in the first control unit 101, the second control unit 103, the first output unit 105 and the second output unit 107 are N-type transistors, the second control unit 103 is configured to receive the second power source signal VGH, and the first and second output units 105 and 107 receive the first power source signal VGL.

Figure 2:
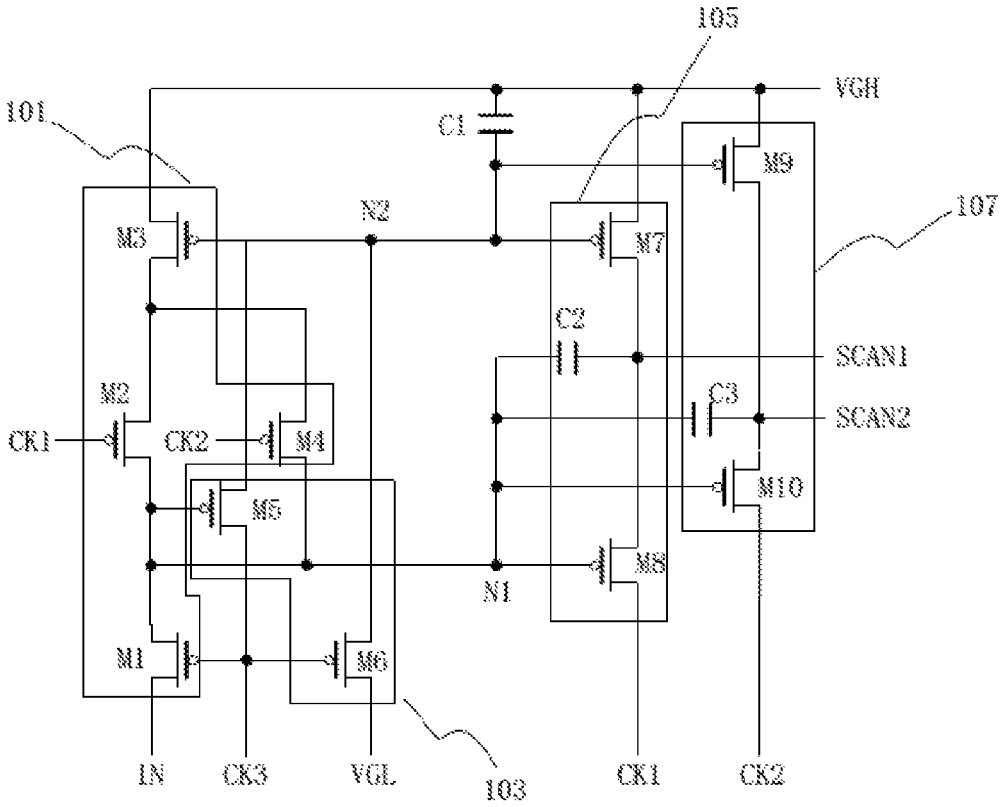
FIG. 2 is a gate scan circuit provided by embodiments of the present disclosure.

FIG. 2 illustrates a gate scan circuit provided by the embodiments of the present disclosure. In FIG. 2, the first control unit 101 includes a first transistor M1, a second transistor M2, a third transistor M3 and a fourth transistor M4. In the embodiment shown in FIG. 2, a gate electrode of the first transistor M1 is configured to receive the third clock signal CK3, a first electrode of the first transistor M1 is configured to receive the first input signal IN, and a second electrode of the first transistor M1 is connected to the first node N1. A gate electrode of the second transistor M2 is configured to receive the first clock signal CK1, a first electrode of the second transistor M2 is connected to the first node N1, and a second electrode of the second transistor M2 is connected to a second electrode of the third transistor M3. A gate electrode of the third transistor M3 is connected to the second node N2, a first electrode of the third transistor M3 is configured to receive the second power source signal VGH. A gate electrode of the fourth transistor M4 is configured to receive the second clock signal CK2, a first electrode of the fourth transistor M4 is connected to the first node N1, and a second electrode of the fourth transistor M4 is connected to the second electrode of the second transistor M2.

Alternatively, the second control unit 103 includes a fifth transistor M5 and a sixth transistor M6. In one embodiment, a gate electrode of the fifth transistor M5 is connected to the first node N1, a first electrode of the fifth transistor M5 is configured to receive the third clock signal CK3, and a second electrode of the fifth transistor M5 is connected to the second node N2. A gate electrode of the sixth transistor M6 is configured to receive the third clock signal CK3, a first electrode of the sixth transistor M6 is configured to receive the first power source signal VGL, and a second electrode of the sixth transistor M6 is connected to the second node N2.

Alternatively, the first output unit 105 includes a seventh transistor M7, an eighth transistor M8 and a second capacitor C2. In the embodiment shown in FIG. 2, a gate electrode of the seventh transistor M7 is connected to the second node, a first electrode of the seventh transistor M7 is configured to receive the second power source signal VGH, and a second electrode of the seventh transistor M7 is connected to a first scan output terminal SCAN1. A gate electrode of the eighth transistor M8 is connected to the first node N1, a first electrode of the eighth transistor M8 is configured to receive the first clock signal CK1, and a second electrode of the eighth transistor M8 is connected to the first scan output terminal SCAN1. A first terminal of the second capacitor C2 is connected to the first node N1, and a second terminal of the second capacitor C2 is connected to the first scan output terminal SCAN1.

Alternatively, the second output unit 107 includes a ninth transistor M9, a tenth transistor M10 and a third capacitor C3. In one embodiment, a gate electrode of the ninth transistor M9 is connected to the second node N2, a first electrode of the ninth transistor M9 is configured to receive the second power source signal VGH, and a second electrode of the ninth transistor M9 is connected to the second scan output terminal SCAN2. A gate electrode of the tenth transistor M10 is connected to the first node N1, a first electrode of the tenth transistor M10 is configured to receive the second clock signal CK2, and a second electrode of the tenth transistor M10 is connected to the second scan output terminal SCAN2. A first terminal of the third capacitor C3 is connected to the first node N1, and a second terminal of the third capacitor C3 is connected to the second scan output terminal SCAN2.

With the gate scan circuit illustrated in FIG. 2, the entire circuit structure adopts a single type of transistors, and two scan signals may be outputted form one circuit with relative less number of transistors, thereby narrowing the frame.

It should be noted that, with respect to the gate scan circuit illustrated in FIG. 2, all the transistors included therein are P-type transistors. However, it is not intended to be limiting. For the purpose of simplifying manufacturing process and reducing cost, all the included transistors may be replaced by N-type transistors. In this case the first electrode of the sixth transistor M6 is configured to receive the second power source signal VGH, and the first electrode of the ninth transistor M9 is configured to receive the first power source signal VGL.

Figure 3:
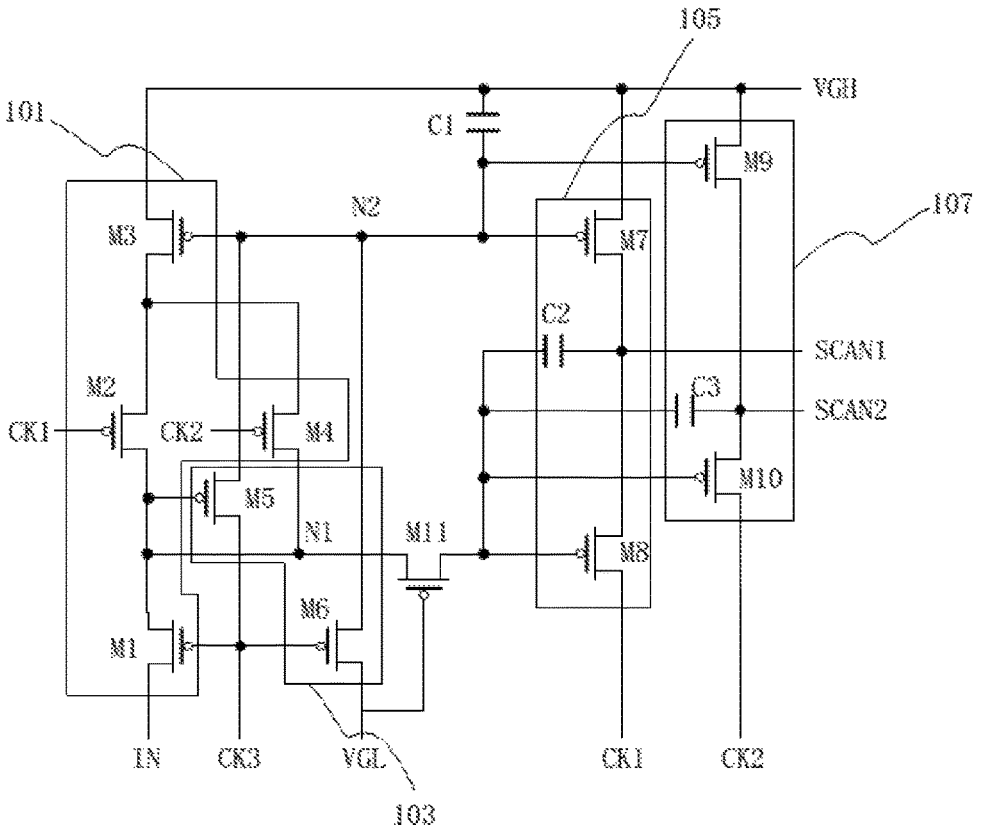
FIG. 3 is another gate scan circuit provided by embodiments of the present disclosure.

FIG. 3 is another gate scan circuit provided by the embodiments of the present disclosure. FIG. 3 has substantially the same circuit structure with FIG. 2, which will not be described again. FIG. 3 differs from FIG. 2 in that an eleventh transistor M11 is further included in the embodiment shown in FIG. 3. A gate electrode of the eleventh transistor M11 is configured to receive the first power source signal VGL, a first electrode of the eleventh transistor M11 is connected to the first node N1, and a second electrode of the eleventh transistor M11 is connected to the first output unit 105. In particular, the second electrode of the eleventh transistor M11 is connected to the gate electrode of the eighth transistor M8. An advantage of using the eleventh transistor M11 is that: since the gate electrode of the eleventh transistor M11 is configured to receive the first power source signal VGL, the eleventh transistor M11 is always turned on, and meanwhile the second electrode of the eleventh transistor M11 is connected to the gate electrode of the eighth transistor M8. As such, when the first clock signal CK1 received by the first electrode of the eighth transistor M8 switches to a low level from a high level of a previous time period, the level of the second electrode of the eighth transistor M8 (i.e., the level at the second terminal of the second capacitor C2) will also switch to a low level from a high level, and a substantially identical level change will occur in the level at the first terminal of the second capacitor C2 (i.e., the level at the gate electrode of the eighth transistor M8) due to the coupling effect of the second capacitor C2, and thus the level at the gate electrode of the eighth transistor M8 may be further pulled down, thereby ensuring a full turned on of the eighth transistor M8. That is, the circuit with the eleventh transistor M11 in FIG. 3 is advantageous over the circuit without the eleventh transistor M11 in FIG. 2 in that: in the circuit without the eleventh transistor M11, the coupling effect of the second capacitor C2 on the level at the gate electrode of the eighth transistor M8 is reduced, and thus the eighth transistor M8 will not be fully turned on; while in the circuit with the eleventh transistor M11, the level at the gate electrode of the eighth transistor M8 will be further pulled down, thereby ensuring a full turned on of the eighth transistor M8.

Figure 4:
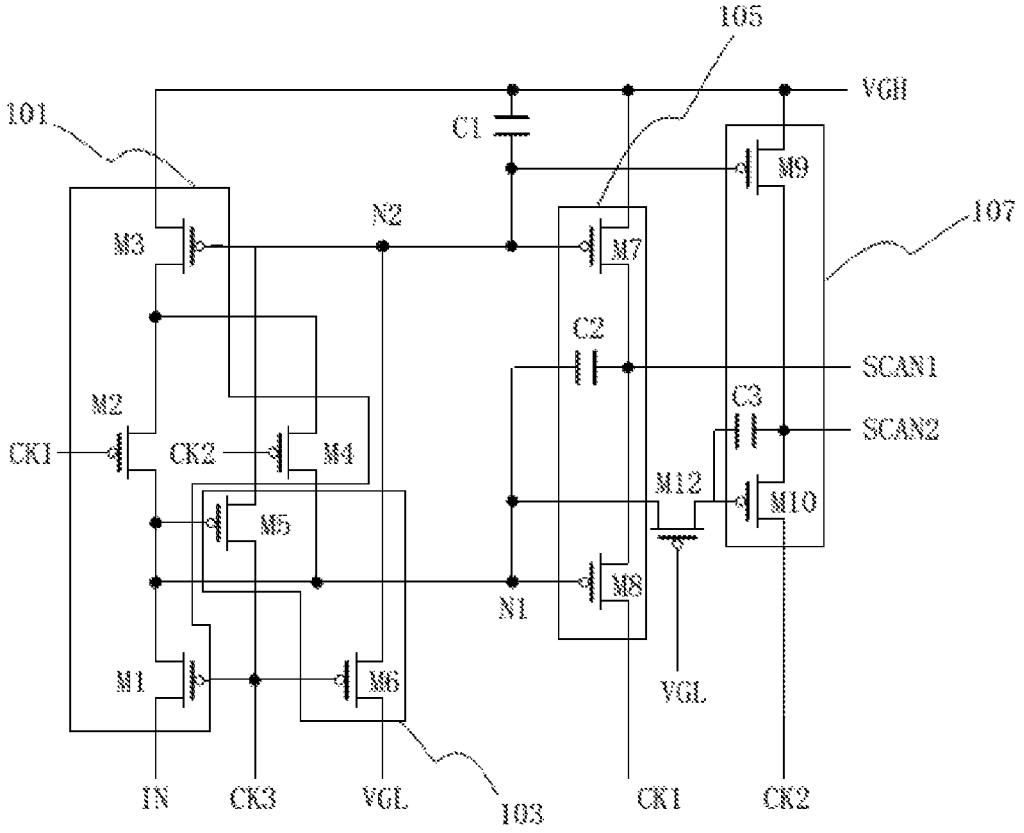
FIG. 4 is another gate scan circuit provided by embodiments of the present disclosure.

FIG. 4 is another gate scan circuit provided by the embodiments of the present disclosure. FIG. 4 has substantially the same circuit structure with FIG. 2, which will not be described again. FIG. 4 differs from FIG. 2 in that a twelfth transistor M12 is further included in FIG. 4.

A shown in FIG. 4, a gate electrode of the twelfth transistor M12 is configured to receive the first power source signal VGL, a first electrode of the twelfth transistor M12 is connected to the first node N1, and a second electrode of the twelfth transistor M12 is connected to the second output unit 107. In particular, the second electrode of the twelfth transistor M12 is connected to the gate electrode of the tenth transistor M10. An advantage of using the twelfth transistor M12 is that: since the gate electrode of the twelfth transistor M12 is configured to receive the first power source signal VGL, the twelfth transistor M12 is always turned on, and meanwhile the second electrode of the twelfth transistor M12 is connected to the gate electrode of the tenth transistor M10. As such, when the second clock signal CK2 received by the first electrode of the tenth transistor M10 switches to a low level from a high level of a previous time period, the level of the second electrode of the tenth transistor M10 (i.e., the level at the second terminal of the third capacitor C3) will also switch to a low level from a high level, and a substantially identical level change will occur in the level at the first terminal of the third capacitor C3 (i.e., the level at the gate electrode of the tenth transistor M10) due to the coupling effect of the third capacitor C3, and the level at the gate electrode of the tenth transistor M10 may be further pulled down, thereby ensuring a full turned on of the tenth transistor M10. That is, the circuit with the twelfth transistor M12 in FIG. 4 is advantageous over the circuit without the twelfth transistor M12 in FIG. 2 in that: in the circuit without the twelfth transistor M12, the coupling effect of the third capacitor C3 on the level at the gate electrode of the tenth transistor M10 is reduced, and thus the tenth transistor M10 will not be fully turned on; while in the circuit with the twelfth transistor M12, the level at the gate electrode of the tenth transistor M10 may be further pulled down, thereby ensuring a full turned on of the tenth transistor M10.

Figure 5:
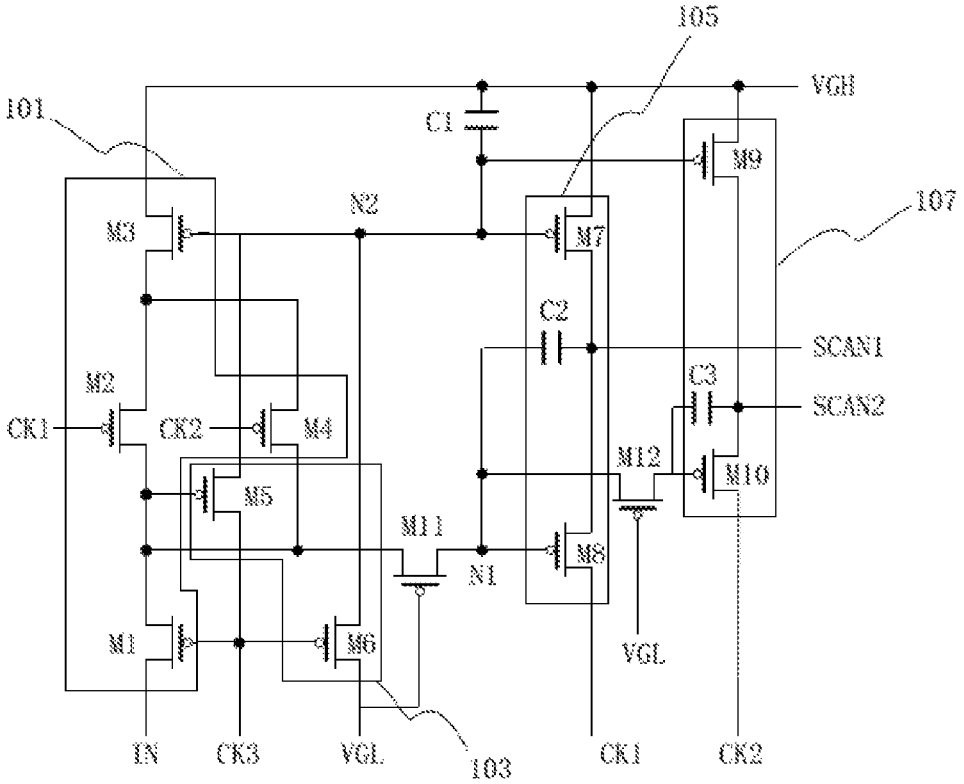
FIG. 5 is another gate scan circuit provided by embodiments of the present disclosure.

Alternatively, referring to FIG. 5, which is another gate scan circuit provided by the embodiments of the present disclosure. In particular, the eleventh transistor M11 and the twelfth transistor M12 are provided simultaneously on the basis of FIG. 2. The detailed connection relation may be referred to in the embodiments provided in FIGS. 3 and 4, which will not be described again. The embodiment of circuit design in FIG. 5 is advantageous over the circuit in FIG. 2 in that: with the eleventh transistor M11 and the twelfth transistor M12, levels at the gate electrodes of the eighth transistor M8 and the tenth transistor M10 may be further pulled down, thereby ensuring fully turned on of the eighth transistor M8 and the tenth transistor M10. The detailed advantages may be referred to in the embodiments provided in FIGS. 3 and 4, which will not be described again.

Figure 6:
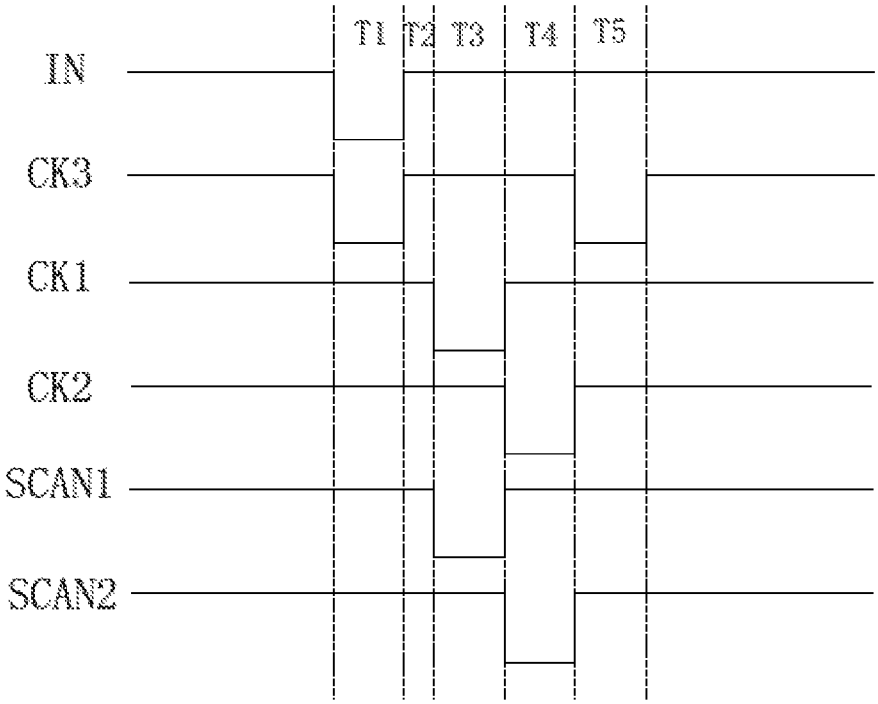
FIG. 6 is a method for driving a gate scan circuit provided by embodiments of the present disclosure.

Further, taking the scan circuit disclosed in FIG. 2 for example, a method for driving the gate scan circuit will be described in detail. In particular, FIG. 6 is a method for driving the gate scan circuit provided by the embodiments of the present disclosure.

During a first time period T1, the first control unit 101 and the second control unit 103 enable both of the first scan signal outputted from the first output unit 105 and the second scan signal outputted from the second output unit 107 to be high level signals by controlling both of the voltages at the first node N1 and the second node N2 to be low level.

In particular, during the first time period T1, the first input signal IN and the third clock signal CK3 are both at low level, and the first clock signal CK1 and the second clock signal CK2 are both at high level. Gate electrodes of the first transistor M1 and the sixth transistor M6 are turned on by receiving the third clock signal CK3 that is at low level at this time. Accordingly, the first input signal IN that is at low level at this time is transmitted to the first node N1 via the first transistor M1. Meanwhile, the fifth transistor M5 is also turned on since its gate electrode is configured to receive the first input signal IN that is at low level at this time. Accordingly, the third clock signal CK3 that is at low level at this time is transmitted to the second node N2 via the fifth transistor M5. The first power source signal VGL is also transmitted to the second node N2 via the sixth transistor M6. That is, during the first time period T1, both of the first node N1 and the second node N2 are at low level, and correspondingly the seventh transistor M7, the eighth transistor M8, the ninth transistor M9 and the tenth transistor M10 are turned on. During this time period, the first clock signal CK1, the second clock signal CK2 and the second power source signal VHG are the same, which are at high level, accordingly, during the first time period T1, the first scan signal outputted from the first scan output terminal SCAN1 is a high level signal, and the second scan signal outputted from the second scan output terminal SCAN2 is a high level signal.

During a second time period T2, the first control unit 101 and the second control unit 103 enable both of the first scan signal 1 outputted from the first output unit 105 and the second scan signal outputted from the second output unit 107 to be high level signals by controlling the voltage at the first node N1 to be low level and the voltage at the second node N2 to be high level.

In particular, during the second time period T2, both of the first input signal IN and the third clock signal CK3 are switched to a high level from the low level of the first time period T1. Gate electrodes of the first transistor M1 and the sixth transistor M6 are turned off by receiving the third clock signal CK3 that is at high level at this time. At this time, the first node N1 is maintained at the low level of the first time period T1 by the level keeping effect of the second capacitor C2 and the third capacitor C3. Accordingly, the fifth transistor M5 maintains the turned on state, and the third clock signal CK3 that is at high level at this time is transmitted to the second node N2 via the fifth transistor M5. That is, during the second time period T2, the first node N1 is at low level, and the second node N2 is at high level. Accordingly, the seventh transistor M7 and the ninth transistor M9 are turned off, and the eighth transistor M8 and the tenth transistor M10 are turned on. Accordingly, the first clock signal CK1 that is at high level at this time is transmitted to the first scan output terminal SCAN1 via the eighth transistor M8, and the second clock signal CK2 that is at high level at this time is transmitted to the second scan output terminal SCAN2 via the tenth transistor M10. That is, during the second time period T2, the first scan signal outputted from the first scan output terminal SCAN1 is a high level signal, and the second scan signal outputted from the second scan output terminal SCAN2 is a high level signal.

During a third time period T3, the first control unit 101 and the second control unit 103 enable the first scan signal outputted from the first output unit 105 to be a low level signal and the second scan signal outputted from the second output unit 107 to be a high level signal by controlling the voltage at the first node N1 to be low level and the voltage at the second node N2 to be high level.

In particular, during the third time period T3, both of the first input signal IN and the third clock signal CK3 are maintained at a high level. The first transistor M1 and the sixth transistor M6 maintain the turned off state. At this time, the first node N1 is maintained at a low level of the first time period T1 and the second time period T2 by the level keeping effect of the second capacitor C2 and the third capacitor C3. Accordingly, the fifth transistor M5 maintains the turned on state, and the third clock signal CK3 that is at high level at this time is transmitted to the second node N2 via the fifth transistor M5. That is, during the third time period T3, the first node N1 is at low level, and the second node N2 is at high level. Accordingly, the seventh transistor M7 and the ninth transistor M9 are turned off, and the eighth transistor M8 and the tenth transistor M10 are turned on. Accordingly, the first clock signal CK1 that is at low level at this time is transmitted to the first scan output terminal SCAN1 via the eighth transistor M8, and the second clock signal CK2 that is at high level at this time is transmitted to the second scan output terminal SCAN2 via the tenth transistor M10. That is, during the third time period T3, the first scan signal outputted from the first scan output terminal SCAN1 is a low level signal, and the second scan signal outputted from the second scan output terminal SCAN2 is a high level signal.

During a fourth time period T4, the first control unit 101 and the second control unit 103 enable the first scan signal outputted from the first output unit 105 to be a high level signal and the second scan signal outputted from the second output unit 107 to be a low level signal by controlling the voltage at the first node N1 to be low level and the voltage at the second node N2 to be high level.

In particular, during the fourth time period T4, both of the first input signal IN and the third clock signal CK3 are maintained at high level. The first transistor M1 and the sixth transistor M6 maintain the turned off state. At this time, the first node N1 is maintained at a low level of a previous time period by the level keeping effect of the second capacitor C2 and the third capacitor C3. Accordingly, the fifth transistor M5 maintains the turned on state, and the third clock signal CK3 that is at high level at this time is transmitted to the second node N2 via the fifth transistor M5. That is, during the fourth time period T4, the first node N1 is at low level, and the second node N2 is at high level. Accordingly, the seventh transistor M7 and the ninth transistor M9 are turned off, and the eighth transistor M8 and the tenth transistor M10 are turned on. Accordingly, the first clock signal CK1 that is at high level at this time is transmitted to the first scan output terminal SCAN1 via the eighth transistor M8, and the second clock signal CK2 that is at low level at this time is transmitted to the second scan output terminal SCAN2 via the tenth transistor M10. That is, during the fourth time period T4, the first scan signal outputted from the first scan output terminal SCAN1 is a high level signal, and the second scan signal outputted from the second scan output terminal SCAN2 is a low level signal.

During a fifth time period T5, the first control unit 101 and the second control unit 103 enable both of the first scan signal outputted from the first output unit 105 and the second scan signal outputted from the second output unit 107 to be high level signals by controlling the voltage at the first node N1 to be high level and the voltage at the second node N2 to be low level.

In particular, during the fifth time period T5, the first input signal IN maintains a high level of the previous time period, and the third clock signal CK3 is switched to be low level signal from the high level of the previous time period. The first transistor M1 and the sixth transistor M6 are turned on again by receiving the third clock signal CK3 that is at low level at this time. Accordingly, the first input signal IN that is at high level at this time is transmitted to the first node N1 via the first transistor M1. Meanwhile, the fifth transistor M5 is also turned off since its gate electrode is configured to receive the first input signal IN that is at high level at this time. Accordingly, the first power source signal VGL that is at low level at this time is transmitted to the second node N2 via the sixth transistor M6. That is, during the fifth time period T5, the first node N1 is at high level, and the second node N2 is at low level. Accordingly, the seventh transistor M7 and the ninth transistor M9 are turned on, and the eighth transistor M8 and the tenth transistor M10 are turned off. Accordingly, the second power source signal VGH that is at high level is transmitted to the first scan output terminal SCAN1 via the seventh transistor M7, and the second power source signal VGH that is at high level is transmitted to the second scan output terminal SCAN2 via the ninth transistor M9. That is, during the fifth time period T5, the first scan signal outputted from the first scan output terminal SCAN1 is a high level signal, and the second scan signal outputted from the second scan output terminal SCAN2 is a high level signal.

With the method for driving the gate scan circuit provided by the embodiment of FIG. 6, two scan signals may be outputted simultaneously using a simple circuit design, and in the driving method, the scan signal is shifted during the scan period of one frame.

It should be noted that in the driving method disclosed in FIG. 6, the signal switching time periods of the first clock signal CK1, of the second clock signal CK2 and of the third clock signal CK3 do not overlap with one another. Since the driving method is described with respect to the all P-type circuit illustrated in FIG. 2, each signal in FIG. 6 are at high level during most of the time in each frame. However, this is not intended to be limiting. Alternatively, when the circuit corresponding to the driving timing of FIG. 6 is an all N-type circuit, by simply reversing the phases of all the signals in FIG. 6, two scan signals may also be outputted simultaneously using a simple circuit design, and the scan signal may be shifted during the scan period of one frame. The detailed process will not be described again.

Figure 7:
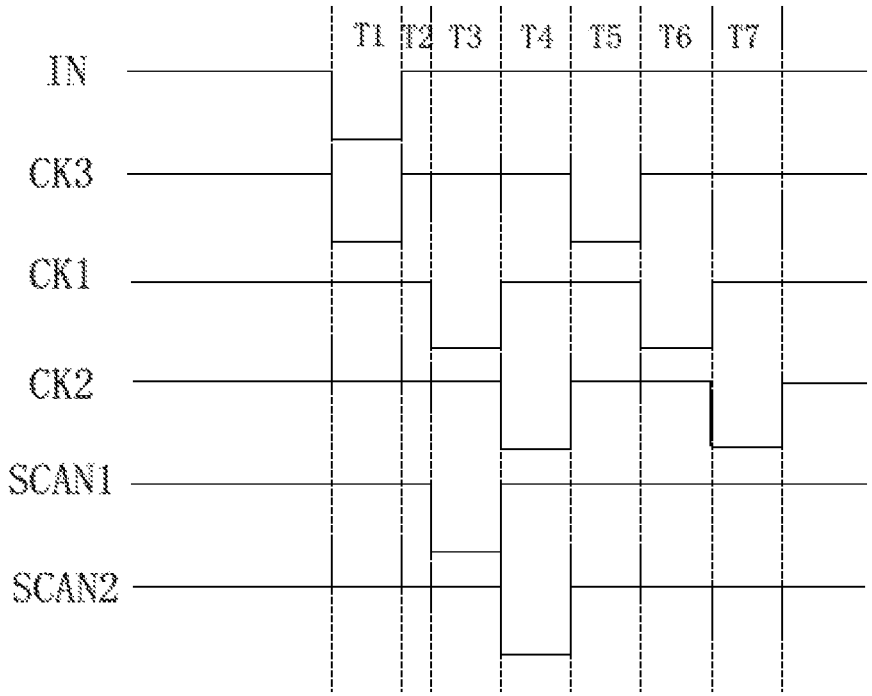
FIG. 7 is another method for driving a gate scan circuit provided by embodiments of the present disclosure.

Alternatively, referring to FIG. 7, which is another method for driving a scan circuit provided by the embodiments of the present disclosure. Comparing with the driving method illustrated in FIG. 6, the driving method disclosed in FIG. 7 includes a first time period T1 to a seventh time period T7. In the embodiment, the first time period T1 through the fifth time period T5 are identical to those disclosed in FIG. 6, which will not be described again. FIG. 7 differs from FIG. 6 in that the driving method disclosed in FIG. 7 further includes the sixth time period T6 and the seventh time period T7.

During the sixth time period T6, the first control unit 101 and the second control unit 103 enable both of the first scan signal outputted from the first output unit 105 and the second scan signal outputted from the second output unit 107 to be high level signals by controlling the voltages at the first node N1 and the second node N2 to be high level and low level, respectively.

In particular, during the sixth time period T6, both of the first input signal IN and the third clock signal CK3 are high level signals. The first transistor M1 and the sixth transistor M6 maintain the turned off state. The second node N2 maintains a low level of the previous time period by the level keeping effect of the first capacitor C1. Accordingly, the third transistor M3 is turned on, and meanwhile the gate electrode of the second transistor M2 is configured to receive the first clock signal CK1 that is at low level at this time and thus the second transistor M2 is turned on. Accordingly, the second power source signal VGH that is at high level is transmitted to the first node N1 via the third transistor M3 and the second transistor M2. That is, during the sixth time period T6, the first node N1 is at high level and the second node N2 is at low level. Accordingly, the seventh transistor M7 and the ninth transistor M9 are turned on, and the eighth transistor M8 and the tenth transistor M10 are turned off. Accordingly, the second power source signal VGH that is at high level is transmitted to the first scan output terminal SCAN1 via the seventh transistor M7, and the second power source signal VGH that is at high level is transmitted to the second scan output terminal SCAN2 via the ninth transistor M9. That is, during the sixth time period T6, the first scan signal outputted from the first scan output terminal SCAN1 is a high level signal, and the second scan signal outputted from the second scan output terminal SCAN2 is a high level signal.

During the seventh time period T7, the first control unit 101 and the second control unit 103 enable both of the first scan signal outputted from the first output unit 105 and the second scan signal outputted from the second output unit 107 to be high level signals by controlling the voltages at the first node N1 and the second node N2 to be high level and low level, respectively.

In particular, during the seventh time period T7, both of the first input signal IN and the third clock signal CK3 are high level signals. The first transistor M1 and the sixth transistor M6 maintain the turned off state. The second node N2 maintains a low level of the previous time period by the level keeping effect of the first capacitor C1. Accordingly, the third transistor M3 is turned on, and meanwhile the gate electrode of the fourth transistor M4 is configured to receive the second clock signal CK2 that is at low level at this time and thus the fourth transistor M4 is turned on. Accordingly, the second power source signal VGH that is at high level is transmitted to the first node N1 via the third transistor M3 and the fourth transistor M4. That is, during the seventh time period T7, the first node N1 is at high level and the second node N2 is at low level. Accordingly, the seventh transistor M7 and the ninth transistor M9 are turned on, and the eighth transistor M8 and the tenth transistor M10 are turned off. Accordingly, the second power source signal VGH that is at high level is transmitted to the first scan output terminal SCAN1 via the seventh transistor M7, and the second power source signal VGH that is at high level is transmitted to the second scan output terminal SCAN2 via the ninth transistor M9. That is, during the seventh time period T7, the first scan signal outputted from the first scan output terminal SCAN1 is a high level signal, and the second scan signal outputted from the second scan output terminal SCAN2 is a high level signal.

With the method for driving the scan circuit provided by the figure, the sixth time period T6 and the seventh time period T7 are further provided in comparison with that provided by FIG. 6, and the stability of the output scan signal of the scan circuit may be increased by continuously writing the high level signal to the first node N1 with the sixth time period T6 and the seventh time period T7.

Figure 8:
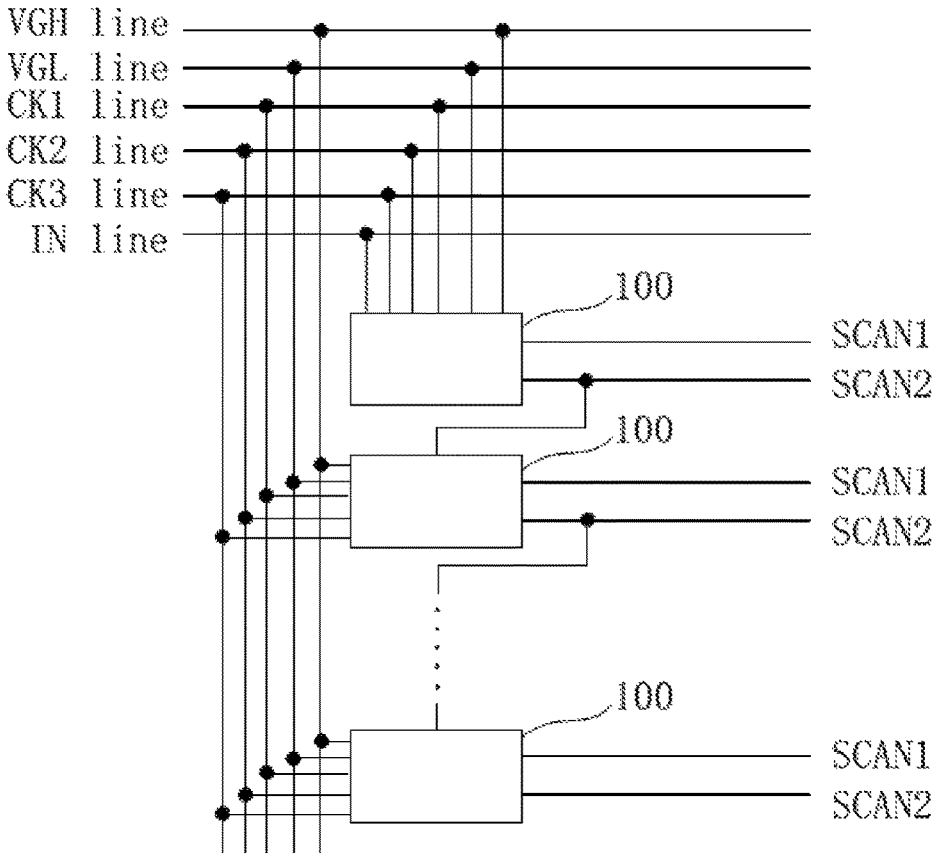
FIG. 8 is a method for driving a gate scan cascade circuit provided by embodiments of the present disclosure.

FIG. 8 is a gate scan cascade circuit provided by the embodiment of the present disclosure, which includes: a first clock signal line CK1 line, a second clock signal line CK2 line, a third clock signal line CK3 line, a first power source signal line VGL line, a second power source signal line VGH line and a first input signal line IN line; and a plurality of cascaded gate scan circuits 100 as disclosed in FIG. 1 through FIG. 5. Each of the gate scan circuits 100 is configured to receive the signals from the first clock signal line CK1 line, the second clock signal line CK2 line, the third clock signal line CK3 line, the first power source signal line VGL line, the second power source signal line VGH line and the first input signal line IN line, and outputs a first scan signal from a first scan output terminal SCAN1 and a second scan signal from a second scan output terminal SCAN2. In the embodiment, with respect to the first stage gate scan circuits 100, the initializing signal is the signal from the first input signal line IN line, and with respect to the second stage gate scan circuits 100 through the last stage gate scan circuits 100, the initializing signal of each stage gate scan circuits 100 is the second scan signal outputted from the second scan output terminal SCAN2 of the previous stage gate scan circuits 100.

As described above, a gate scan circuit, a driving method thereof and a gate scan cascade circuit provided by the embodiments of the present disclosure are described in detail, and principles and implementations of the present disclosure are set forth herein with detailed examples. However, the above description of the embodiments is only provided for facilitating the understanding of the method and concept of the present disclosure. Meanwhile, to those ordinary skilled in the art, detailed implementations and application ranges may be changed according to the concept of the present disclosure. Accordingly, the above description should not be interpreted as limitations to the present disclosure.

What is claimed is:

1. A method for driving a gate scan circuit, the gale scan circuit comprising:

a first control unit configured to control a voltage at a first node based on a first clock signal, a second clock signal, a third clock signal and a first input signal;

a second control unit configured to control a voltage at a second node based on the third clock signal and a first power source signal;

a first output unit configured to output the first clock signal or a second power source signal based on the voltage at the first node or the second node;

a second output unit configured to output the second clock signal or the second power source signal based on the voltage at the first node or the second node; and a first capacitor comprising a first terminal configured to receive the second power source signal and a second terminal connected to the second node, wherein the method comprises:

during a first time period, a level signal of the first control unit and the second control unit for controlling the voltages at the first node and the second node are low level signal, and a first scan signal outputted from the first output unit and a second scan signal outputted from the second output unit are both high level signal;

during a second time period, the level signal of the first control unit for controlling a first voltage at the first node is low level signal, the level signal of the second control unit for controlling the voltage at the second node is high level signal, and the first scan signal outputted from the first output unit and the second scan signal outputted from the second output unit are both high level signal;

during a third time period, the level signal of the first control unit for controlling the first voltage at the first node is low level signal, the level signal of the second control unit for controlling the voltage at the second node is high level signal, the first scan signal outputted from the first output unit is low level signal, and the second scan signal outputted from the second output unit is high level signal;

during a fourth time period, the level signal of the first control unit for controlling the first voltage at the first node is low level signal, the level signal of the second control unit for controlling the voltage at the second node is high level signal, the first scan signal outputted from the first output unit is high level signal, and the second scan signal outputted from the second output unit is low level signal; and during it fifth time period, the level signal of the first control unit for controlling the first voltage at the first node is high level signal, the level signal of the second control unit for controlling the voltage at the second node is low level signal, and a first scan signal outputted from the first output unit and a second scan signal outputted from the second output unit are both high level signal.

2. The method according to claim 1, wherein during the first time period, for achieving the level signals and the scan signals therein:

the first input signal and the third clock signal are low, and the first clock signal and the second clock signal are high;

the first input signal is transmitted to the first node via a first transistor;

the low level signal at the first node controls an eighth transistor and a tenth transistor to be on;

a fifth transistor is also controlled to be on by receiving the first input signal;

the third clock signal is transmitted to the second node via the fifth transistor;

the first power source signal is transmitted to the second node via a sixth transistor;

the low level signal at the second node controls a seventh transistor and a ninth transistor to be turned on;

the first scan signal outputted from a first scan output terminal is a high level signal; and the second scan signal outputted from a second scan output terminal is a high level signal;

during the second time period, for achieving the level signals and the scan signals therein:

the first input signal and the third clock signal are low, and the first clock signal and the second clock signal are high;

the first transistor and the sixth transistor are turned off by receiving the third clock signal;

the first node is maintained at the low level of the first time period by a second capacitor and a third capacitor;

the fifth transistor maintains the turned-on state;

the third clock signal is transmitted t to e second node via the fifth transistor;

the high level at the second node controls the seventh transistor and the ninth transistor to be turned off;

the low level at the first node controls the eighth transistor and the tenth transistor to be turned on;

the first clock signal is transmitted to the first scan output terminal via the eighth transistor;

the first scan signal outputted from the first scan output terminal is a high level signal;

the second clock signal is transmitted to the second scan output terminal via the tenth transistor; and the second scan signal outputted from the second scan output terminal is a high level signal;

during the third time period, for achieving the level signals and the scan signals therein:

both of the first input signal and the third clock signal are maintained at high level;

the first transistor and the sixth transistor maintain the turned-off state;

the first node is maintained at the low level of the second time period by the second capacitor and the third capacitor, accordingly;

the fifth transistor maintains the turned-on state;

the third clock signal is transmitted to the second node via the fifth transistor;

the high level signal at the second node controls the seventh transistor and the ninth transistor to be turned off;

the low level signal at the first node controls the eighth transistor and the tenth transistor to be turned on;

the first clock signal is transmitted to the first scan output terminal via the eighth transistor;

the first scan signal outputted from the first scan output terminal is a low level signal;

the second clock signal is transmitted to the second scan output terminal via the tenth transistor; and the second scan signal outputted from the second scan output terminal is a high level signal;

during the fourth time period, for achieving the level signals and the scan signals therein:

both of the first input signal and the third clock signal are maintained at high level;

the first transistor and the sixth transistor maintain the turned-off state;

the first node is maintained at the low level of the third time period by the second capacitor and the third capacitor, accordingly;

the fifth transistor maintains the turned on state;

the third clock signal is transmitted to the second node via the fifth transistor;

the high level signal at the second node controls the seventh transistor and the ninth transistor to be turned off;

the low level signal at the first node controls the eighth transistor and the tenth transistor to be turned on;

the first clock signal is transmitted to the first scan output terminal via the eighth transistor; the first scan signal outputted from the first scan output terminal is a high level signal;

the second clock signal is transmitted to the second scan output terminal via the tenth transistor; and the second scan signal outputted from the second scan output terminal is a low level signal; and during the fifth time period, for achieving the level signals and the scan signals therein:

the first input signal maintains a high level of the previous time period:

the third clock signal is switched to be low level signal;

the third clock signal controls the first transistor and the sixth transistor to be turned on;

the first input signal is transmitted to the first node via the first transistor; the first input signal controls the fifth transistor to be turned off;

the first power source signal is transmitted to the second node via the sixth transistor;

the low level at the second node controls the seventh transistor and the ninth transistor to be turned on;

the high level at the first node controls the eighth transistor and the tenth transistor to be turned off;

the second power source signal is transmitted to the first scan output terminal via the seventh transistor;

the first scan signal outputted from the first scan output terminal is a high level signal;

the second power source signal is transmitted to the second scan output terminal via the ninth transistor; and the second scan signal outputted from the second scan output terminal is a high level signal.

3. The method according to claim 1, further comprising:

during a sixth time period, the level signal of the first control unit for controlling the first voltage at the first node is high level signal, the level signal of the second control unit for controlling the voltage at the second node is low level signal, such that the first scan signal outputted from the first output unit and the second scan signal outputted from the second output unit are both high level signal; and during a seventh time period, the level signal of the first control unit for controlling the first voltage at the first node is high level signal, the level signal of the second control unit for controlling the voltage at the second node is low level signal, such that the first scan signal outputted from the first output unit and the second scan signal outputted from the second output unit are both high level signal.

4. The method according to claim 3, wherein during the sixth time period, for achieving the level signals and the scan signals therein:

both of the first input signal and the third clock signal are high level signals;

the first transistor and the sixth transistor maintain the turned off state;

the second node maintains the low level of the previous time period by the first capacitor, accordingly;

a third transistor is turned on;

the first clock signal controls a second transistor to be turned on;

the second power source signal is transmitted to the first node via the third transistor and the second transistor;

the low level at the second node controls the seventh transistor and the ninth transistor to be turned on;

the first clock signal controls the second transistor to be turned on, accordingly;

the second power source signal is transmitted to the first node via the third transistor and the second transistor, accordingly;

the second power source signal is transmitted to the first scan output terminal via the seventh transistor;

the first scan signal outputted from the first scan output terminal is a high level signal;

the second power source signal is transmitted to the second scan output terminal via the ninth transistor; and the second scan signal outputted from the second scan output terminal is a high level signal; and during the seventh time period, for achieving the level signals and the scan signals therein:

both of the first input signal and the third clock signal are high level signals;

the first transistor and the sixth transistor maintain the turned off state;

the second node maintains the low level of the previous time period by the first capacitor, accordingly;

the third transistor is turned on;

the second clock signal controls a fourth transistor to be turned on;

the second power source signal is transmitted to the first node via the third transistor and the fourth transistor;

the low level signal at the second node controls the seventh transistor and the ninth transistor to be turned on;

the high level signal at the first node controls the eighth transistor and the tenth transistor to be turned off, accordingly;

the second power source signal is transmitted to the first scan output terminal via the seventh transistor;

the first scan signal outputted from the first scan output terminal is a high level signal;

the second power source signal is transmitted to the second scan output terminal via the ninth transistor; and the second scan signal outputted from the second scan output terminal is a high level signal.

* * * * *